United States Patent [19]

McCormick

[11] Patent Number: 4,703,986

[45] Date of Patent: Nov. 3, 1987

[54] BUTT CONTACT FOR AN ELECTRICAL CONNECTOR HAVING EMI SHIELDING

[75] Inventor: Larry L. McCormick, Los Angeles, Calif.

[73] Assignee: G & H Technology, Inc., Santa Monica, Calif.

[21] Appl. No.: 896,846

[22] Filed: Aug. 15, 1986

[51] Int. Cl.[4] ..... H01R 25/00

[52] U.S. Cl. ..... 439/607; 439/891; 439/751

[58] Field of Search ..... 339/48, 49, 59 R, 59 M, 339/143, 111, 253, 256

[56] References Cited

FOREIGN PATENT DOCUMENTS 410098 10/1966 Switzerland ..... 339/49 B

*Primary Examiner*—Gil Weidenfeld
*Assistant Examiner*—Paula A. Austin
*Attorney, Agent, or Firm*—George J. Netter

[57] ABSTRACT

An electrical contact for use in a releasable connector part having a closed-end metal shell with resilient springlike sidewalls, the shell closed-end contactingly covering an opening in a shield plate when the connector is unmated. When mated, a corresponding contact in the other connector part passes through the shield plate opening moving the metal shell closed-end away from the shield plate and into current conducting relation with a shaft connected with a cable wire. In an alternate version, the metal shell closed-end moves into connective relation with an end wall of a further metal shell interconnected with the cable wire.

9 Claims, 4 Drawing Figures

BUTT CONTACT FOR AN ELECTRICAL CONNECTOR HAVING EMI SHIELDING

The present invention pertains generally to releasable electrical connectors and, more particularly, to such an electrical connector having improved butt contacts which automatically close off and shield the electrical connector on separation of the connector parts effecting isolation from external electromagnetic fields.

BACKGROUND OF THE INVENTION

A plug and receptacle connector with which the present invention is most advantageously employed includes plug and receptacle connector parts which are releasably mated to one another in order to interconnect one or more cable wires via internally located contacts. One commonly employed type of contacts consist of pin and socket contacts having male and female parts which are conductively joined on mating of the connector parts to effect the desired electrical interconnection. The pin and socket contacts are mated and unmated by relative movement along a single straight line axis and any attempt to separate the connector parts along other directions will damage or destroy the connector contacts.

It is necessary in certain uses and circumstances (e.g., emergencies) to be able to rapidly release such a connector by relative movement of the connector parts in any of several different directions. For this purpose there is a known type of contacts for use in plug and receptacle connectors in which a male pin contact merely abuts against the end of a spring-loaded contact when the connector parts are joined to form an electrical connection therebetween. These "butt" contacts have the special utility of being able to withstand transverse bending forces applied to the connector, such as may happen when a connector is only partially mated or has been mated and inadvertently loosened. A decided advantage over pin and socket contacts is that transverse bending forces when applied to a pin and socket contact can break or damage the contacts impairing operation of the connector and producing electrical shorts. Still further, butt contacts can be disconnected by moving the connector parts transversely from one another rather than merely toward and away from one another.

SUMMARY OF THE DISCLOSURE

An electrical connector with which the described invention can be advantageously utilized includes plug and receptacle parts which are releasably mated together in order to connect one or more cable wires via included electrical contacts. The plug connector part consists of a metal shell within which there is received a rubber or plastic insert having openings therein to receive respectively pin-like contacts extending from a front face thereof. A resilient interface rubber or plastic seal is located on the front of the insert and through which the outer ends of the pin contact extend.

The receptacle includes an outer metal shell within which a plastic or rubber insert is received similarly having a plurality of openings therethrough corresponding in number and arrangement to the pins in the plug and within which receptacle openings there are individually received bellows contacts having forwardly extending concave surfaces adapted to receive the end of the pin contact in use. The outer or front face of the receptacle also includes a grid plate which completely covers the face except for a plurality of openings directly opposite each of the bellows contacts. The grid plate is conductively secured at its edges and integral with the receptacle shell.

Each bellows contact includes an elongated solder post to which cable wire can be soldered or, alternatively, crimped. At the opposite end, a spring-like bellows member has an outer end part with a concavity at its end adapted to receive the outer end of a pin contact in abutting conductive relationship in use. More particularly, each bellows contact is mounted such that in the unmated condition the bellows extends and completely closes off each opening in the grid plate thereby effecting an EMI shield for the conductors.

On mating of the plug and receptacle the pin contact exerts a force against the bellows moving it away from its shielding condition to the grid plate and into full contact with the solder post thereby establishing the desired connection aspect.

In accordance with an alternative version, the contacts used in each of the connector parts are identical and each of the connector parts includes a grid plate which covers the connector part front except for access openings to the individual contacts. Each contact includes a base portion having an open end for receiving a cable wire to be soldered or crimped therein and a split-pin end. A bellows shell is located about the split pin end and which bellows is normally spaced from the split end of the pin when the bellows is in extended relation and when compressed is in conductive contacting relationship with the split end of the pin. A rod-like pin affixed to the outer end of the bellows extends through a grid opening and projects outwardly from the grid surface. An insulative interface plate is received over the grid plate outer face and includes openings which are aligned with the respective openings for the contacts and through which extend the rod-like extensions of the bellows. When the plug and receptacle connector parts are axially joined together, the rod-like extension of the two bellows contacts abut against one another and press the bellows on each until there is a full conductive relationship between the pins, bellows and rod-like extensions thereof, and in that way effect the desired connection between the cable wires.

DESCRIPTION OF PREFERRED EMBODIMENTS

A well-known plug and receptacle connector at the present time includes receptacle parts which are releasably joined to plug parts for effecting electrical connection between pairs of contacts mounted within the respective connector parts. In the usual case, the contacts are male and female (i.e., pin and socket) which requires that the connector parts be mated and unmated solely by axial movements of the parts. There are many circumstances in which it is desirable that the electrical connectors be capable of unmating by connector part movements which may be either axial or transversely thereof. In the latter case, male and female contacts are not feasible in that the male members will be broken or damaged in the event of transverse movement, and for that reason so-called butt contacts have been developed. As the name implies, a pair of butt contacts effect electrical connection by a male member which bearing against a receiving surface to effect electrical connection, but is not anchored or entrapped within an opening or cavity so that on transverse movement between the connector parts the male member can slip sideways without becoming broken or damaged or damaging on the other contact. The invention to be described herein is a category of butt contact of improved construction and operation.

Figure 1:
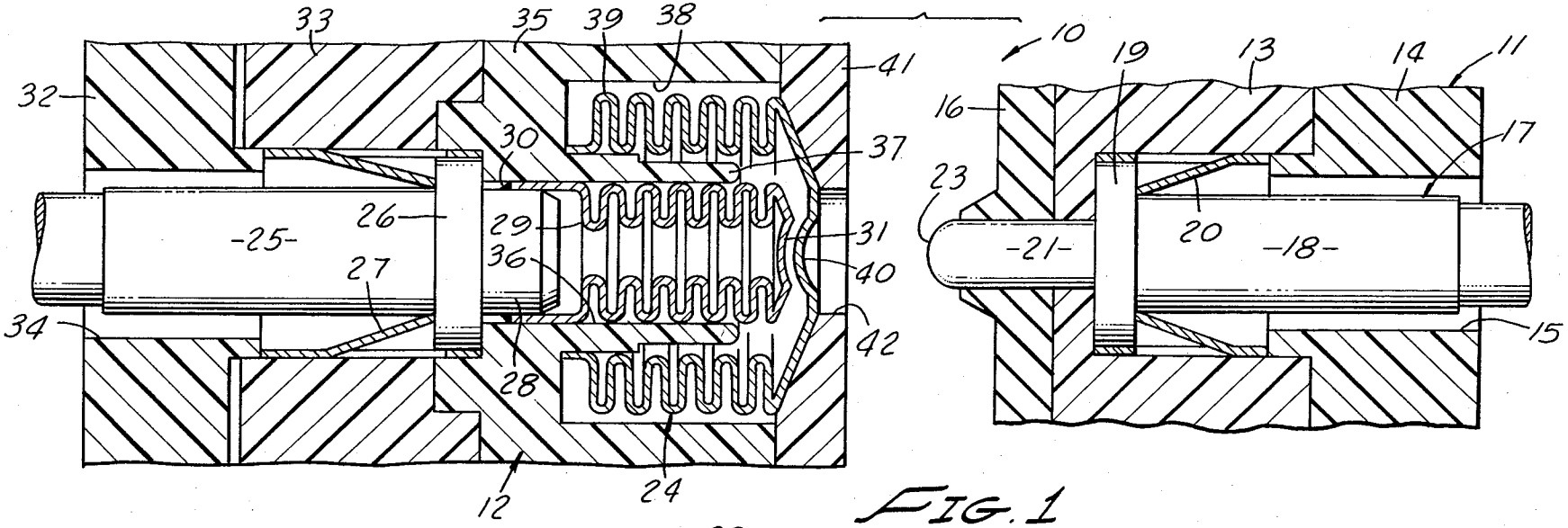
FIG. 1 is a side elevational, sectional view of a first version of butt contacts shown in separated or unmated condition.
Figure 2:
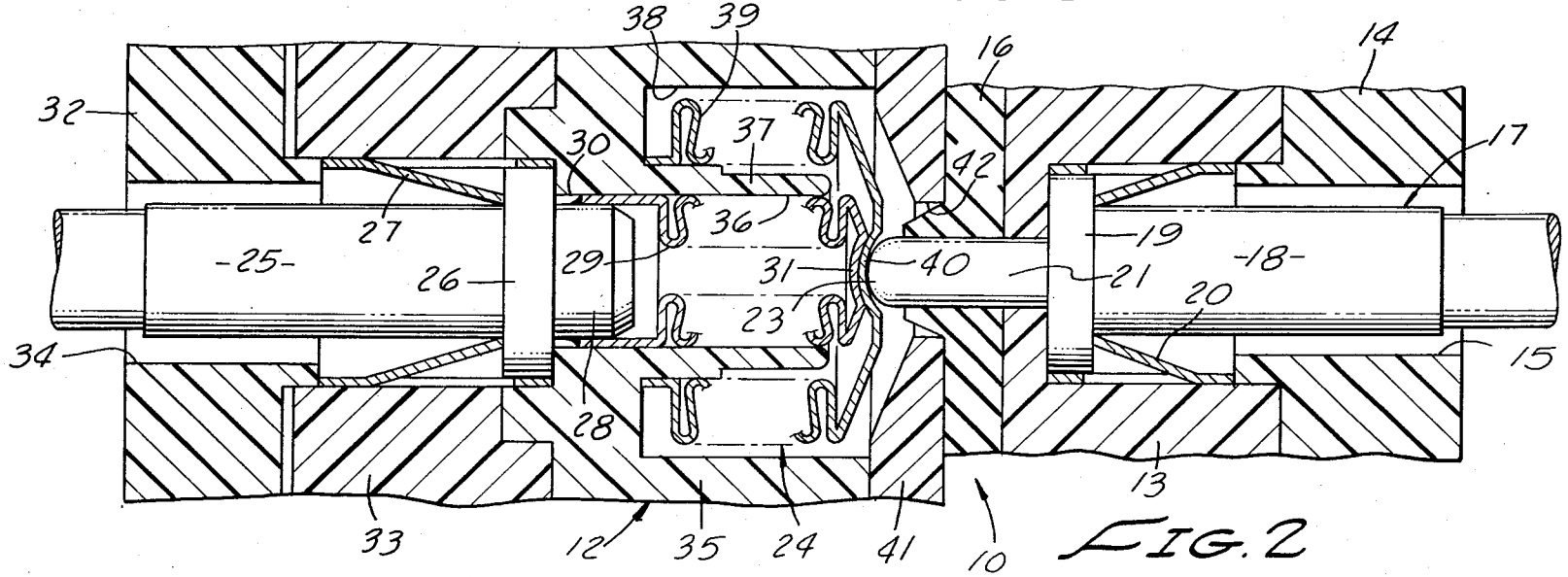
FIG. 2 is a side elevational, sectional view of the contacts of FIG. 1 shown fully mated.

Turning now to the drawings, and particularly FIGS. 1 and 2, there is shown a first version of the present invention including connector 10 having first and second connector parts 11 and 12 respectively which can be releasably joined or mated to effect electrical connection between a pair of butt contacts to be described.

The electrical connector typically includes cylindrical metal shells as a outer housing for the connector (not shown in the drawing) and within which shells there are provided insulative inserts 13 and 14 constructed of rubber or plastic having openings 15 for individual receipt of a contact for the defined purpose of interconnecting pairs of cable wires (not shown). A soft rubber or plastic innerface layer 16 also is provided on that surface of the insert 13 facing the other connector part in order to effect a seal during connector mating to prevent dust, dirt and moisture from invading the connector.

The connector part 11 includes a male contact 17 constructed of metal and having a hollow tubular shaft 18 within which a cable wire is received and either soldered or crimped in place. An enlarged flange 19 is integral with the cylindrical shaft 18 and serves as a locking means behind which spring like fingers 20 snap when the contact is inserted into the opening 15. Axially extending from the opposite face of the flange 19 is a male pin 21 coaxial with the cylindrical shaft 18, the outer end of which is provided with a radius enumerated as 23. the interface seal 16 has an opening through which the radiused end of the pin extends.

The outer contact, which will be referred to herein as the bellows contact, is enumerated generally as 24 and includes a hollow, cylindrical metal shaft 25 within one end of which a cable wire is either soldered or crimped. An enlarged flange 26 (similar to the flange 19 in the first described contact) serves as a means for locking the entire bellows contact within an insert opening in cooperation with spring means 27. A metallic stub shaft 28 extends from the opposite side of the flange 26 and is coaxial with shaft 25.

A core bellows electrode 29 is generally cylindrical having a closed end and an open end, the open end being snugly received onto the stub shaft 28 to which it is welded or silver soldered enumerated as at 30. the core bellows electrode is made of a spring material, the side walls of which are formed into a wave shape thereby giving the bellows a spring-like resiliency along its cylindrical axis. The closed end of the bellows includes a concave axially outwardly facing portion 31 for a purpose to be described.

In assembly of the contact 24 parts described to this point, insulative inserts enumerated as 32 and 33 include an opening 34 therein enabling receipt of the core bellows electrode 29 therethrough and locking the flange 26 behind ends of the spring arms 27 to retain the entire assembly within the connector part inserts.

A further insulative insert 35 has a central opening 36 within which the core bellows electrode 29 and stub shaft 28 are received and completely surrounded by a cylindrical wall 37 of insulative material. Outwardly of the wall 37 there is a further annular opening 38 which is colinear with opening 36 and finally an outer enclosing wall that is integral with the outer insulative material of insert 35. The openings 36 and 38 have an open outer end, namely, the end facing away from the core bellows electrode.

A metallic extension bellows 39 is of a construction similar to the extension bellows 29 only larger in cross-section, generally cylindrical in shape with a closed end and an open end. Bellows electrode 39 is of such dimensions as to permit receipt of the open end about the annular wall 37 and allow the open end to bottom in the opening 38 such that in the unstressed condition all portions of the core bellows electrode 29 are spaced from all parts of the bellows electrode 39. The outer end or closed end wall of 39 includes a centrally located concavity 40 facing axially outwardly which results in a convex inner portion lying along the cylindrical axis of the bellows spaced from and directly opposite the concavity 31 within the bellows electrode 29. A resilient, soft rubber or plastic interface layer 41 is received over the outer surface of the bellows electrode 39 with an opening 42 aligned to the concavity 40.

With reference now to FIG. 2, it is seen that when the connector parts are assembled together to effect mating that the two interface layers 16 and 41 abut one another, at which time the curved end 23 of the pin shaft 21 passes through the opening 42, moves into contact with the concavity 40 of the extension bellows electrode, compresses this bellows until it comes into good contact with the core bellows electrode 29. In this way, there now is a desired continuous electrical conducting relationship between the contact 17 and the contact 24.

When it is desired to unmate the connector parts, this may be accomplished by either applying a releasing movement along the axis of the contacts or along a direction transversely of the longitudinal contact axis. By virture of the bellows spring-like resiliency, transverse movement of the pin shaft 21 merely compresses a portion of the bellows but immediately releases the pin shaft 21 without damaging either the pin shaft or the bellows electrode 39.

Figure 3:
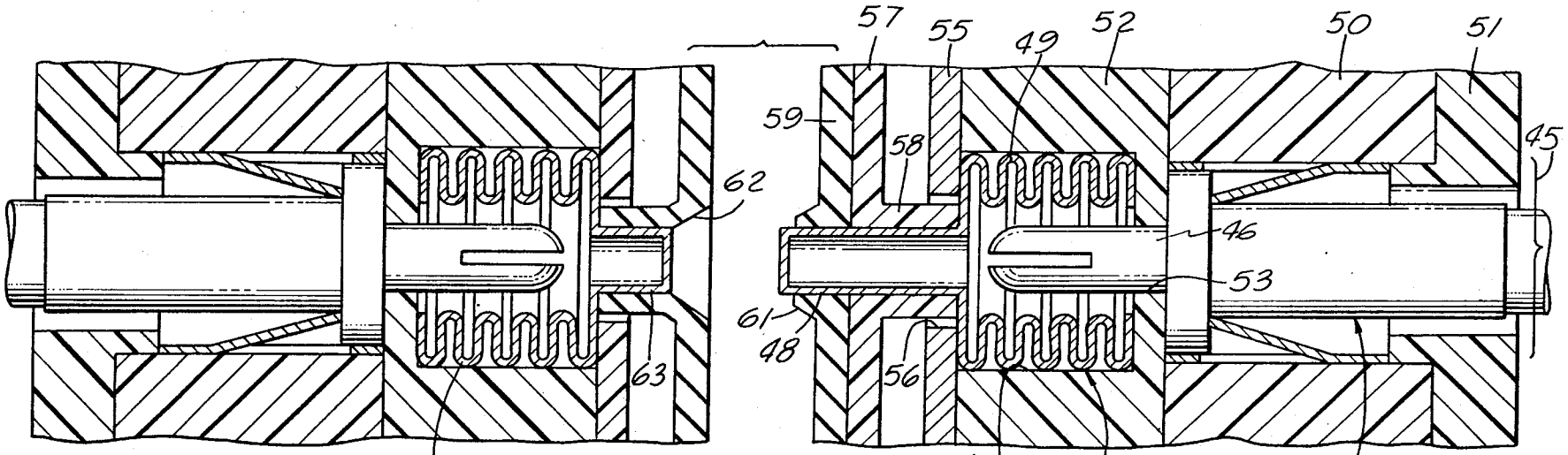
FIG. 3 is a side elevational, sectional view of a further embodiment of butt contacts shown in separated condition.
Figure 4:
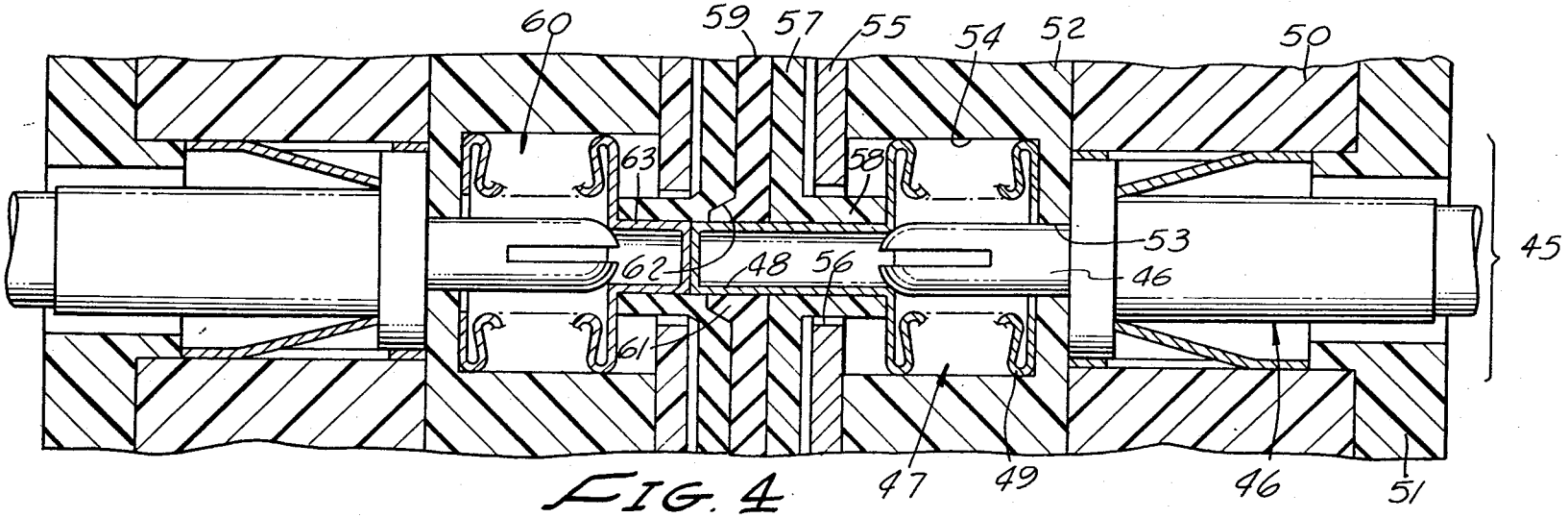
FIG. 4 is a side elevational, sectional view similar to FIG. 3 showing the contacts when mated.

For the ensuing description of an alternative embodiment, reference is now made to FIGS. 3 and 4. In this version, there is really only one contact construction with two such contacts being located in respective connector parts and which coact to effect the desired connection. For that reason, only the details of one contact will be given and that is enumerated generally as 45. The contact includes a part 46 which can be identical to the contact 17 of the first described embodiment. That is, the part 46 has a hollow cylindrical shaft within which a cable wire can be soldered or crimped and coaxially therewith a smaller diameter pin-like member with a rounded end which is separated from the hollow shaft by an enlarged circular flange. The part 46 is lockingly positioned within an opening in a connector part insert by spring fingers as in the first described embodiment.

A compressible electrode 47 includes a hollow, tubular member 48 having a closed outer end and an open end of which is axially affixed to an enlarged cylindrical metal bellows 49. More particularly, the bellows 49 has its walls convoluted or wave-shaped in order to provide spring-like resiliency along the bellows cylindrical axis and has its end opposite the tubular member 48 open. The internal cavity of the tubular member 48 and the bellows 49 are in open communication with each other with the interior diameter of the member 48 being slightly smaller than that of the part 46 pin.

In assembly within a connector part, the contact part 46 is located within first and second insulative inserts 50 and 51 such that the pin of the part 46 extends outwardly therefrom. A further insulative insert 52 has a first opening 53 which fits over the pin of the part 46 and abuts otherwise against the insert 50. The opening 53 is in full communication with an enlarged opening 54 of such diameter as to be able to receive the bellows 49 therewithin to bottom against the inner wall of the insert 52 with the tubular member 48 extending outwardly therefrom.

A grid plate 55 is a conductive metal plate located over the outer wall of the insert 52 and having an opening 56 therein that is oversized in order to allow the tubular member 48 to extend therethrough and still be substantially spaced from the opening side walls. An insulative interface plate 57 has an opening which snugly fits about the tubular member 48 and has integral therewith a hub 58 which abuts against immediately adjacent parts of the bellows 49. An interface seal 59 constructed of a pliant plastic or rubber material is received over the cylindrical member 48 intimately contacting the interface plate 57.

In use, two connector parts are each provided with a contact 45 as shown in FIG. 3. In this unmated position, it is to be noted that the top portions of the bellows 49 abut against the grid plate immediately adjacent the opening 56 thereby forming a shield over the opening against external electromagnetic field penetration which if not prevented could induce interfering signals directly into the contact part 46 and thus into the cable wire connected therewith. Accordingly, connector parts provided with contacts of this kind are protected when not in the mated condition on a continuous basis against contamination by EMI.

Although both contacts of a coacting pair (e.g., contacts 45 and 60) can be identical it is preferable that mounting arrangements for the two be slightly different. For example, the interface seal 59 for the contact 45 includes a raised conical portion 61 surrounding the cylindrical member 48. The connector part with the contact 60 does not require an interface seal, but the interface plate immediately adjacent the contact cylindrical member is formed into a conical cavity 62 which can receive the conical portion 61 therewithin. Also, the cylindrical member 63 may be of shorter length than member 48 in order to have its outer end located at the bottom of cavity 62.

On mating of the two connector parts, the interface seal 59 is brought into intimate contacting relation with the interface plate of the contact 60 and the outer ends of the two cylindrical members 48 have their ends brought into abutment. As further axial pressure is applied, this pressure is transferred into movement of the cylindrical members 48 causing the respective bellows 49 to compress and bring the pin end of the contact parts 46 into full contact with the walls defining the inner end of the cylindrical member 48 (FIG. 4). At this time there is full conductive relation between the contacts and at the same time the bellows 49 are moved out of contact with the grid plates 53. Since essential contact is only made between two flat surfaces, namely, the ends of the cylindrical members 48, when it is desired to unmate the connector, this may be accomplished either by an axial movement or a motion transversely of the cylindrical axis of the members 48 all without any destruction of impairment of the contacts or connector parts.

It is important to note that the pin end of contact 46 is slotted as 63 which provides a springlike resiliency to its contact with the inner surface of cylindrical member 48. This gives a "wiping action" to the interconnector which removes oxides and the like that could reduce contact efficiency.

What is claimed is:

1. An electrical contact for use in an electrical connector part having a metal electromagentic shielding plate enclosing a connector part end portion which faces a further connector part when the two connector parts mate, the shielding plate having an opening therein comprising:

first metal shaft means having an open end for receiving a cable wire therewithin, second metal shaft means integral with said first shaft means, and an enlarged flange located between said first and second shaft means, said shaft means and flange being fixedly mounted within the electrical connector part with the second shaft means spaced from and aligned with the shielding plate opening; and a metal shell having resilient springlike sidewalls, a closed end wall, and an open end wall opposite said closed end wall, said metal shell being fixedly mounted within the connector part with the outer surface of the closed end wall contactingly closing off the shielding plate opening when the resilient springlike sidewalls are relaxed, said shell sidewalls being sufficiently compressible on the closed end wall being moved away from closing off the plate opening to move into contact with the second shaft means.

2. An electrical contact as in claim 1, in which the metal shell is generally cylindrical with the shell sidewalls having a plurality of circular spaced apart folds providing springlike resiliency along the shell cylindrical axis.

3. An electrical contact as in claim 1, in which the metal shell end wall includes a hollow cylindrical member of cross-sectional dimensions less than those of the plate opening which extends through the plate opening in spaced relation to the plate.

4. An electrical contact as in claim 3, in which an insulative member is received in surrounding relationship to the cylindrical member and extending between the cylindrical member outer surface and plate portions defining the plate opening.

5. An electrical contact as in claim 3, in which the second shaft means has a split end portion which moves into the hollow cylindrical member contacting the shell end wall when the end wall moves away from closing off the plate opening.

6. An electrical contact as in claim 5, in which the relative dimensions of the split end portion and the hollow cylindrical member are such that when the split end portion moves into the cylindrical member the split end portion is compressed.

7. An electrical contact, as in claim 1, in which the second shaft means includes a conductive shell having a closed end wall and resilient springlike sidewalls, the conductive shell closed end wall being spaced from the metal shell end wall when it closes off the plate opening, and said conductive shell closed end contacts the metal shell wall when the metal shell wall is moved from closing off the plate opening.

8. An electrical contact as in claim 7, in which the sidewalls of the metal shell and the conductive shell each include a plurality of circular spaced apart folds providing springlike resiliency generally parallel to a line through the folds centers.

9. An electrical contact as in claim 7, in which the respective end walls of the shells have curved portions which are aligned with the plate opening and which nest in one another on the two end walls being brought into contact with each other.

* * * * *